US005396750A

United States Patent [19]

Kleyn

[11] Patent Number: 5,396,750

[45] Date of Patent: Mar. 14, 1995

[54] MODULAR BUILDING PANEL

[75] Inventor: Hendrik Kleyn, Grandville, Mich.

[73] Assignee: Kleyn Die Engravers, Inc., Jenison, Mich.

[21] Appl. No.: 148,619

[22] Filed: Nov. 8, 1993

[51] Int. Cl.[6] ..... E04C 2/34

[52] U.S. Cl. ..... 52/802; 52/807

[58] Field of Search ..... 52/588, 802, 805, 804, 52/275, 281, 282.1, 570, 593, 223.6, 223.7, 223.9, 220.2, 586.1, 586.2, 282.4, 793, 811

[56] References Cited

U.S. PATENT DOCUMENTS

| | | | |
|---|---|---|---|
| 2,228,363 | 1/1941 | Pinney | 52/281 X |
| 3,496,052 | 2/1970 | Odenthal | 52/807 X |
| 4,438,614 | 3/1984 | Raith et al. | 52/802 X |

FOREIGN PATENT DOCUMENTS

| | | | |
|---|---|---|---|
| 327223 | of 1935 | Italy | 52/807 |

*Primary Examiner*—Carl D. Friedman
*Assistant Examiner*—Creighton Smith
*Attorney, Agent, or Firm*—Warner Norcross & Judd

[57] ABSTRACT

A modular building panel wherein building panels are formed of two polymeric panel halves each having ribs with passageways formed integrally therein. The panel halves are joined together along the mating edges of the mating ribs. The passageways do not intersect with the mating edges of the panel halves. The passageways facilitate the installation of wiring and insulation into completed panels.

11 Claims, 8 Drawing Sheets

MODULAR BUILDING PANEL

BACKGROUND OF THE INVENTION

The present invention relates to a modular building panel, and more particularly, to one made of a polymeric material.

The use of modular building panels can result in significant time and labor savings over conventional construction techniques. The panels can be prefabricated in bulk to take advantage of economies of scale and to greatly reduce on-site labor.

In the past, modular building panels have been constructed through the compression of a variety of materials such as sand, sawdust and woodchips. U.S. Pat. No. 2,852,807 issued Sep. 23, 1958, to Altschuler discloses modular building panels constructed by assembly of two panel halves. The panel halves are compressed using a press, and internal voids are created by expanding air cells incorporated into the mold. The internal voids reduce the weight of the panels and reduce the amount of materials necessary for their fabrication. An adhesive is used to join the two panel halves. Dovetailed grooves are molded into the ends of the panels, and completed panels are connected by filling these grooves with cement. The Altschuler panel is relatively heavy. Installation of wire and insulation in the assembled panels is difficult at best. Further, adhesive bonding of adjacent panels is both expensive and labor intensive.

In time, advances in plastic molding technology made it possible for modular building panels to be made from strong and light-weight polymeric materials. U.S. Pat. No. 3,992,839 issued Nov. 23, 1976 to La Borde discloses snap-together modular building panels that employ an interlocking design to adjoin completed panels. The La Borde panels are comprised of two panel halves each separately molded which snap together via male and female connectors molded into the panel halves. The completed panels have either inverted or everted panel ends which interlock to connect adjacent panels. This construction requires two distinctly fashioned panels and therefore two distinct molds. This increases the cost of production and means the panel halves are not completely interchangeable. Further, installation of wiring and insulation is difficult at best.

SUMMARY OF THE INVENTION

The present invention provides a molded polymeric modular building panel formed of two panel halves each having an outer wall and integral ribs. The two panel halves are joined along the mating edges of the ribs and the outer wall. Passageways for the installation of wiring and insulation are integrally formed in each panel half. The passageways are positioned such that they do not intersect with the mating edges of the panel halves. The mating surface between the panel halves is thereby increased, which in turn strengthens the bond between the two panel halves and increases the panel's structural integrity.

According to a preferred feature of the invention, the two panel halves are hot-plate welded along all ribs for structural integrity.

According to an additional preferred feature, the passageways are provided in such a manner that both panel halves are identical. This renders the panel halves entirely interchangeable and reduces fabrication cost by requiring only a single mold.

Also disclosed is a connector piece for connecting completed panels. The connector piece is "H" shaped and receives one end of each of the completed panels in each of its openings. The "H" connector and completed panels are joined by fasteners, welding or adhesive.

An alternative method for joining panels is also disclosed. This method requires that everted lips be fashioned into the ends of the panel halves. Two "C" shaped connectors inserted from opposite directions entrap and secure the mating lips of adjacent panels. The connectors and panel halves can be secured by welding or fasteners.

These and other objects, advantages, and features of the present invention will be more fully understood and readily appreciated by reference to the detailed description of the preferred embodiment and the appended drawings.

DETAILED DESCRIPTION OF THE PREFERRED EMBODIMENT

I. Panels

Figure 1:
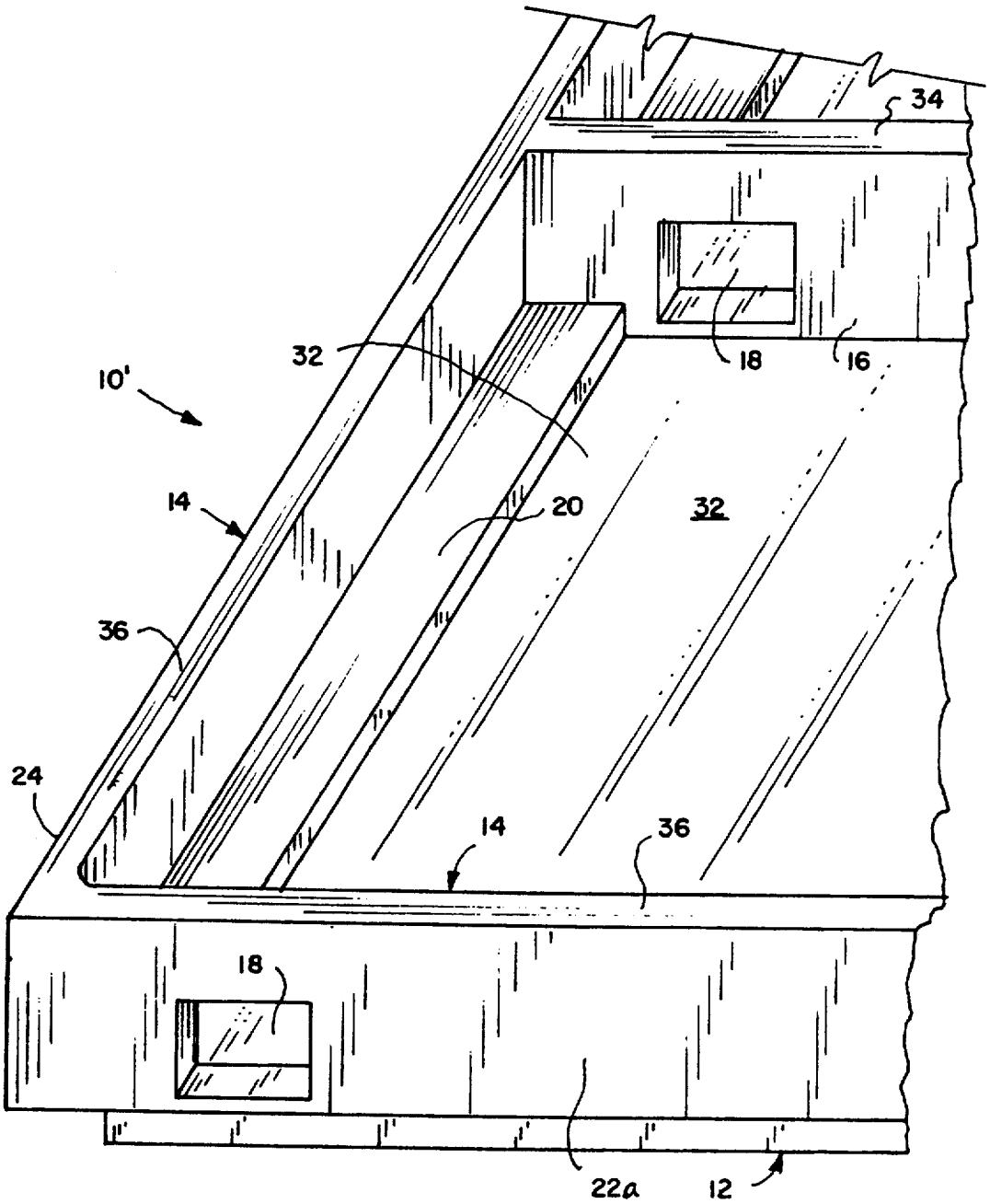
FIG. 1 is a perspective view of a panel half according to the present invention.

Byway of disclosing a preferred embodiment, and not by way of limitation, there is shown in FIG. 1 a portion of a panel half generally designated 10', which includes a front wall 12 an outer wall 14, internal ribs 16 and passageways 18. For ease of description, the direction denoted by arrow 80 is referred to as upward, and the direction denoted by arrow 82 is herein referred to as backward.

The front wall 12 is a generally flat or planar rectangular surface having a circumferential flange 20 recessed approximately the width of the front wall 12 in a backward direction. The outer wall 14 is generally comprised of two side walls 22*a–b*, a top wall 24 and a bottom wall 26, which extend circumferentially around the periphery of the front wall 12. The outer wall 14 is further defined as extending perpendicularly backward from the periphery of the flange 20, and extends to a depth substantially equal to one half the width of a completed panel.

A plurality of internal ribs 16 comprised of longitudinally and laterally extending walls, 28 and 30 respectively, are disposed along the backward surface 32 of the front wall 12, and extend from outer wall 14 to outer wall 14. The internal ribs 16 extend perpendicularly backward from the front wall 12 to such an extent that their backward edges 34 lie in a plane defined by the backward edge 36 of the outer wall 14. The number of internal ribs 16 may vary according to the width and desired strength of the panel halves.

A plurality of openings 38 are defined within the internal ribs 16 and the outer wall 14, and are generally designated passageways 18. The,passageways 18 are disposed such that they do not intersect the backward edge 34 of the internal ribs 16 or outer wall 14. The passageways 18 defined within the lateral internal ribs 16 are in substantial lines alignment, and the passageways 18 defined within the longitudinal internal ribs 16 and the outer wall 14 are in substantial lateral alignment. The number and placement of openings 18 is optional and may vary according to the size of the panels and the desired positioning of wiring or insulation.

Figure 3:
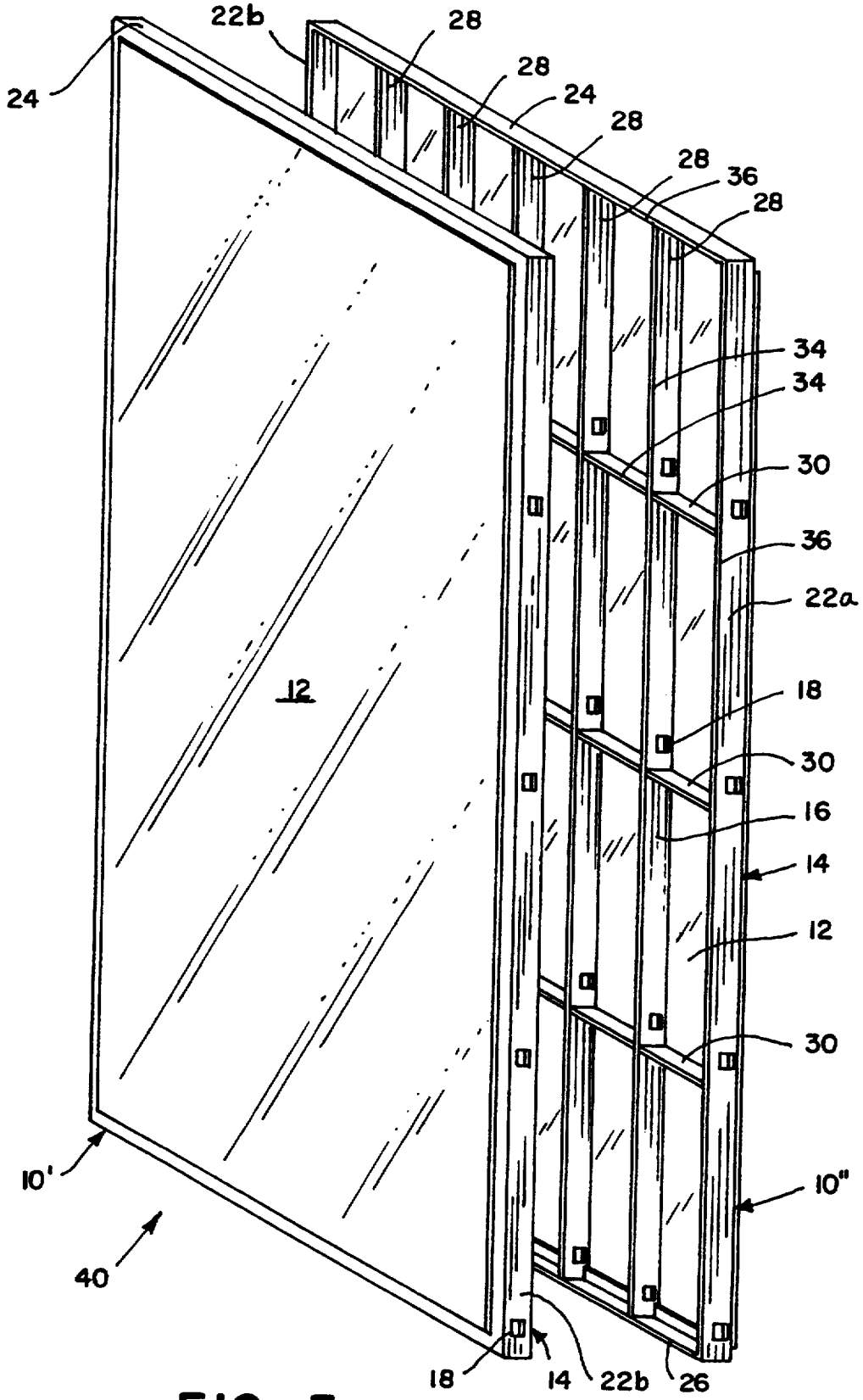
FIG. 3 is a perspective view of two panel halves aligned for assembly.
Figure 4:
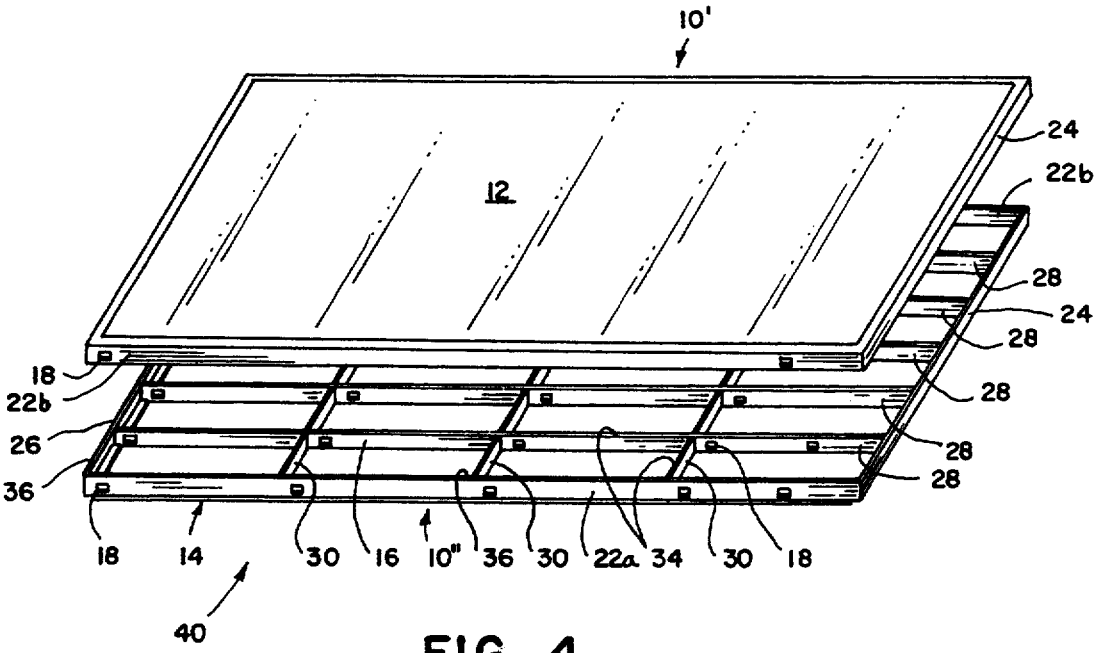
FIG. 4 is a perspective view of two panel halves according to an alternative embodiment of the invention.

As illustrated in FIGS. 3 and 4, the completed modular panels 40 are an assembly of two panel halves 10' and 10''. The two panel halves 10' and 10'' are placed into mating disposition such that the backward edges 36 of the outer walls 14 and the backward edges 34 of the internal ribs 16 of each panel half 10' and 10'' meet. The panel halves 10' and 10'' are hot-plate welded along the mating edges 42 of the internal ribs 16 and the outer walls 14.

In the presently preferred embodiment, the panels are fabricated of polyproylene sold by Dow Chemical Company of Midland, Mich. Of course, other materials and joining/fastening means may vary by application; and the selection of appropriate materials and joining means,will be readily apparent to those skilled in the relevant arts.

II. Panel Assembly

Figure 2:
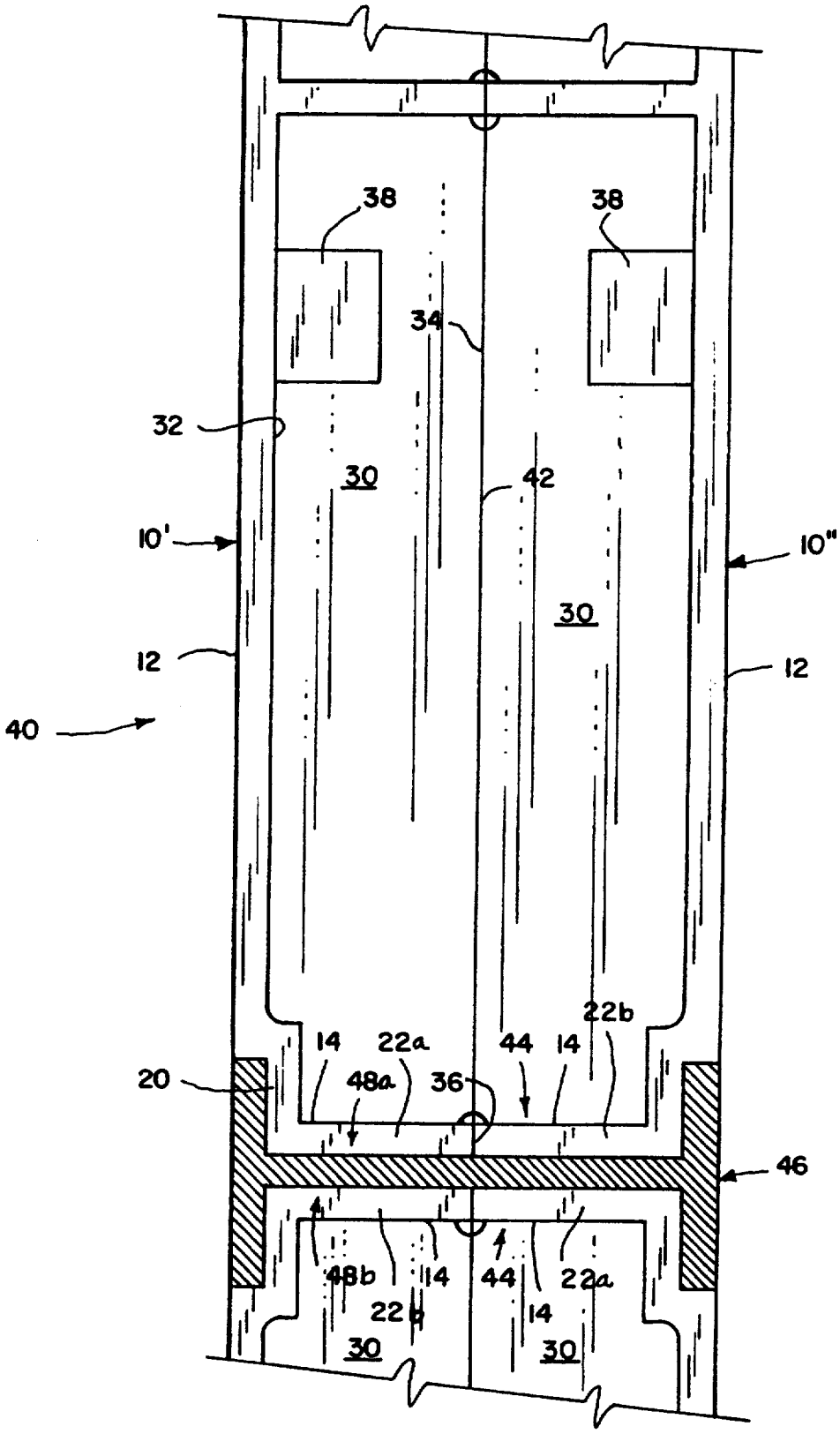
FIG. 2 is a plan, sectional view of a portion of two completed panels joined by an "H" connector.

The completed panels 40 are assembled in alignment to create a wall. The aligned panels are joined to one another through the use of an "H" shaped connector 46, as depicted in FIG. 2. The panel ends 44, which are comprised of the mating side walls 22*a–b* of the outer wall 14, are generally hat-shaped as a result of the recessed flange 20 of the front wall 12. The exterior dimensions of the panel ends 44 are substantially identical to the interior dimensions of the two open ends 48*a–b* of the "H" shaped connector 46. The panel ends 44 of the two adjacent panels are received within opposite open ends of the "H" shaped connector 46. The panel ends 44 and "H" shaped connector 46 are conceivably secured by welding, fasteners, or adhesive (not specifically shown).

Figure 6:
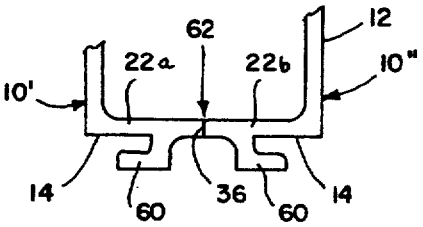
FIG. 6 is a plan, sectional view of an end portion of a completed panel for use with a "C" connector.
Figure 5:
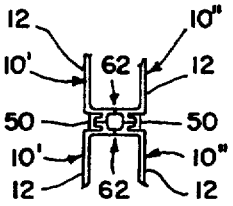
FIG. 5 is a plan, sectional view of a portion of two completed panels joined by a "C" connector.

An alternative method for connecting completed panels is disclosed in FIGS. 5 and 6, wherein the panel ends 44 are shaped to include a "T" shaped flange rather than a hat shaped flange (as depicted in FIG. 2). In this embodiment, the panel halves 10, are generally comprised as described in the previous embodiment. However, the front wall 10 does not include a recessed flange. Instead, an "L" shaped lip 60 extends out from the side walls 22 *a–b* of the outer wall 14. When the two panel halves are joined, the lips cooperate to form a "T" shaped panel end 62. To connect adjacent panels, the panel ends 62 are brought together and a pair of "C" shaped, connectors 50 are inserted from opposite sides over the "T" shaped panel ends 62. Again, the connectors are conceivably secured by welding or fasteners.

III. Panel Molding

As disclosed above, it is desirable to form the passageways 18 in the internal ribs 16 and outer wall 14 simultaneously with the manufacture of the panel halves 10' and 10'' in an injection molding machine. The passageways 18 are undercut, meaning that the openings 38 are disposed such that the panel halves cannot be removed from a male mold unless the mold is specially equipped for release from the undercut openings. A preferred molding apparatus is shown in various configurations in FIGS. 7–13.

Figure 7:
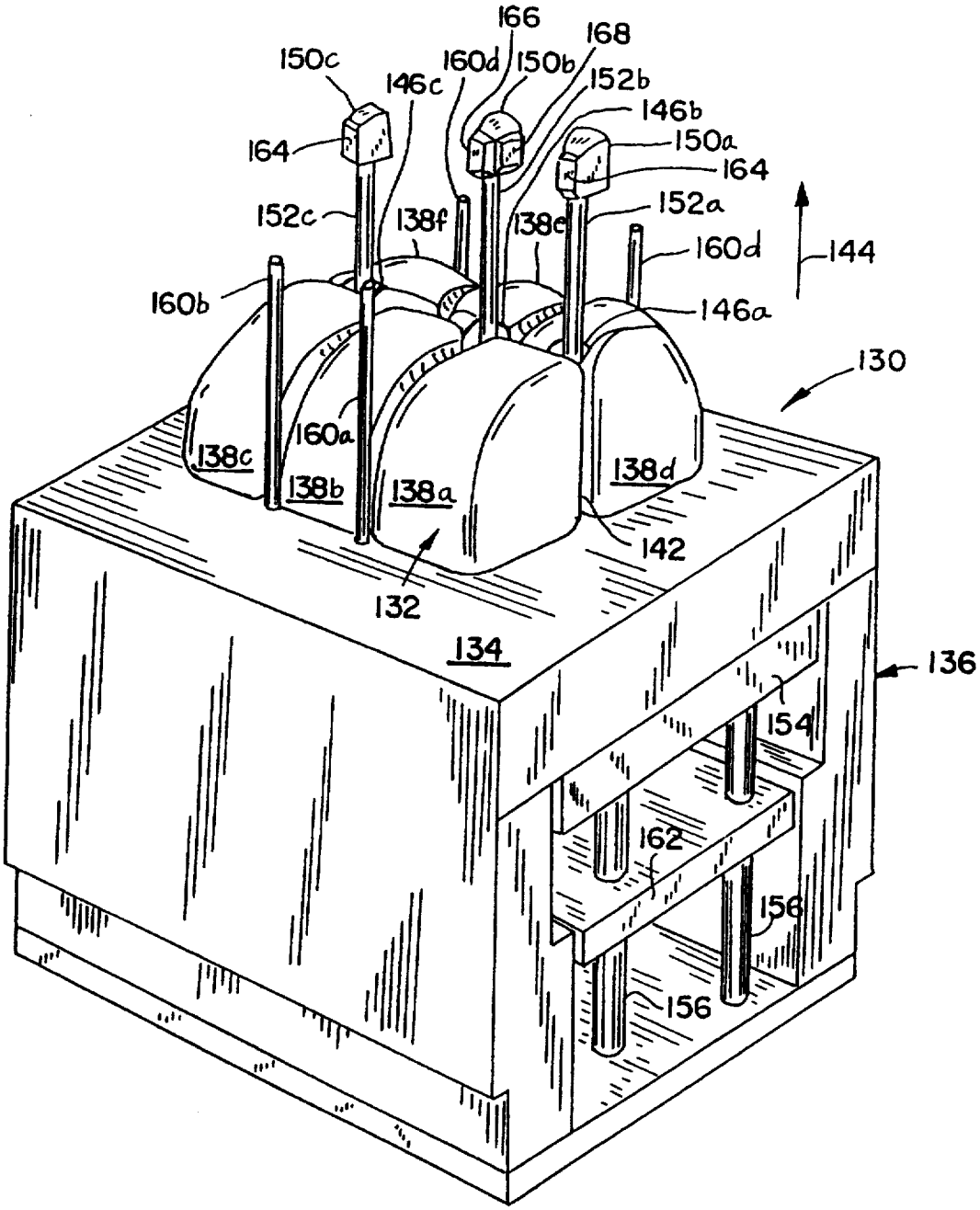
FIG. 7 is a perspective view of a male mold and mold base adapted for manufacturing the panel halves.

There is shown in FIG. 7 a molding apparatus 130 having a male mold 132 affixed to the outwardly directed surface 134 of a mold base 136. The male mold includes several projections 138*a–*138*f* which form the chambers defined by the internal ribs and outer wall to be formed on the mold. Between adjacent pairs of the projections there are formed voids, such as void 142, in which the internal ribs of the panel half are formed.

It should be understood that the molding apparatus is shown in various configurations in FIGS. 7 and 10–13, and that these configurations do not necessarily conform to the shape of the panel halves shown in FIGS. 1–6. These various configurations are included to disclose the constructional and operational features of the molding apparatus as will be apparent from the following description. The molding apparatus may be configured to produce panel halves having any number or arrangement of internal ribs. All that is required is that the panel half have one or more undercut openings extending transversely to the direction in which the panel half is removed from the mold.

The projections 138*a–*138*f* extend outwardly from the mold generally in the same direction in which the panel halves will be removed from the mold as indicated by arrow 144. The direction denoted by arrow 144 is referred to herein as "outward" and is intended to refer to the direction in which the panel half moves substantially away from the male mold after molding is complete. In the embodiment of FIG. 1, this direction is substantially perpendicular to the mold face 134. Where the panel half is to be formed with undercuts, the projections are formed with recesses, such as recesses 146*a–*146*c* in projections 138*d–*138*f*, respectively.

Lifter heads 150*a–*150*c* are shown in their fully extended position. When retracted, the lifter heads are received within the corresponding recesses 146*a–*146*c*. The lifter heads are affixed to the outer ends of lifter rods 152*a–*152*c*. The lifter rods extend through the recesses 146*a–*146 and through holes formed through the mold base 136. The inner ends of the lifter rods 152*a–*152*c* are affixed to a lifter plate 154 which is mounted on guide rods 156 for outward movement to extend the lifter heads, and for inward movement to retract the lifter heads into the recesses 146*a–*146*c*.

Ejector pins 160a–160d are shown in their partially extended position. When retracted, the outer ends of the ejector pins lie flush with the mold face 134. The ejector pins are positioned such that their outer ends contact a surface of the panel half such as the outer wall of the panel half shown in FIG. 1. The ejector pins extend through holes formed through the mold base 136 and through holes formed through the lifter plate 154. The inner ends of the ejector pins are affixed to ejector plate 162 which is mounted on guide rods 156 for outward movement to extend the ejector pins, and for inward movement to retract the ejector pins.

Lifter heads 150a and 150c have single protrusions 164 which form a single undercut opening in an internal rib of the panel half. Lifter head 150b has two protrusions 166, 168 which form the undercut openings in each of two intersecting internal ribs of the panel half adjacent the corner formed at the intersection.

Figure 8:
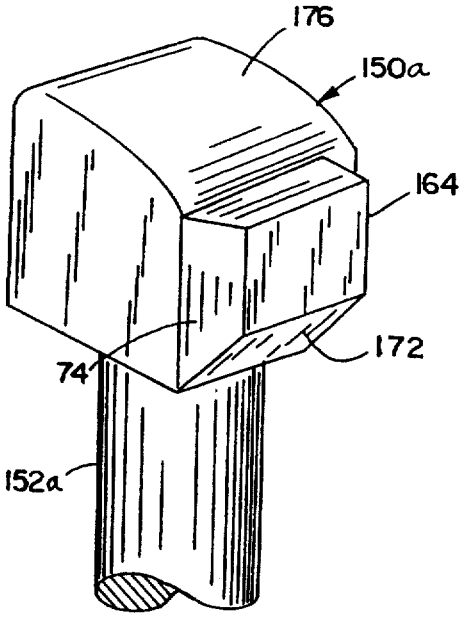
FIG. 8 is an enlarged, perspective, fragmentary view of a lifter head of the apparatus shown in FIG. 7 having a single protrusion.
Figure 13:
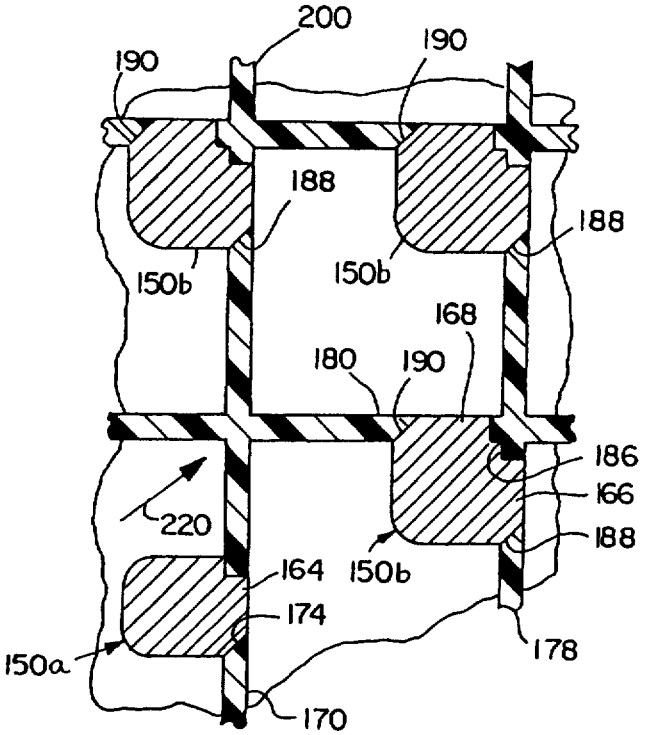
FIG. 13 is a fragmentary, plan, sectional view of a panel half on the lifter heads of the molding apparatus.
Figure 12:
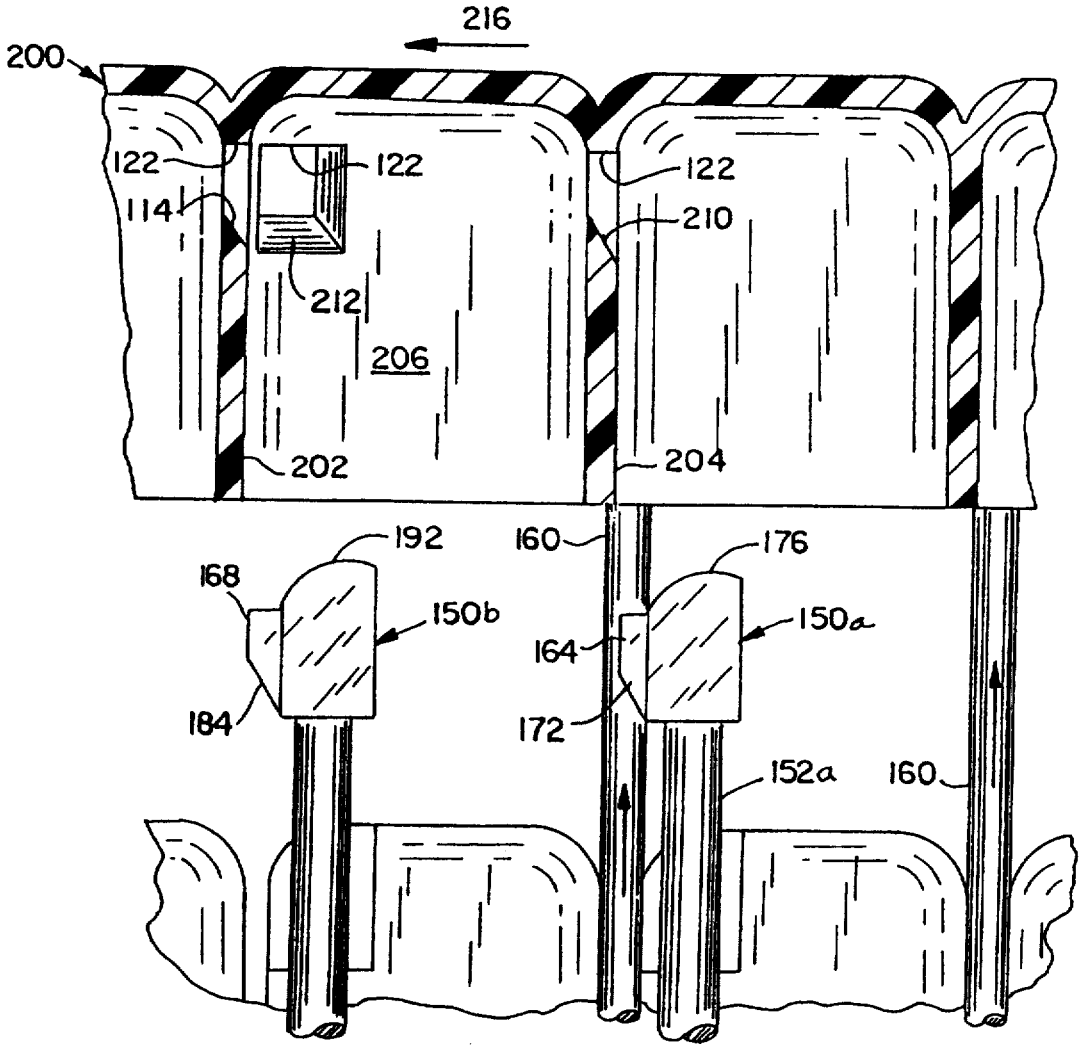
FIG. 12 is similar to FIG. 11 but showing the ejector pins fully extended.

The details of a single protrusion lifter head 150a are shown in FIGS. 8, 12 and 13. The lifter head is enlarged with respect to the lifter rod 152a to which it is affixed. The lifter head is generally four-sided, with protrusion 164 extending transversely into the void of the male mold in which wall 170 of the panel half shown in FIG. 13 is formed. The inwardly directed edge of the protrusion is beveled so as to provide an inward ramping surface 172. Another edge of the protrusion extending generally parallel to the outward direction is beveled so as to provide a sloping release surface 174. The outer surface 176 of the lifter head is shaped to match the contours of the mold projection into which the lifter head is recessed when retracted.

Figure 9:
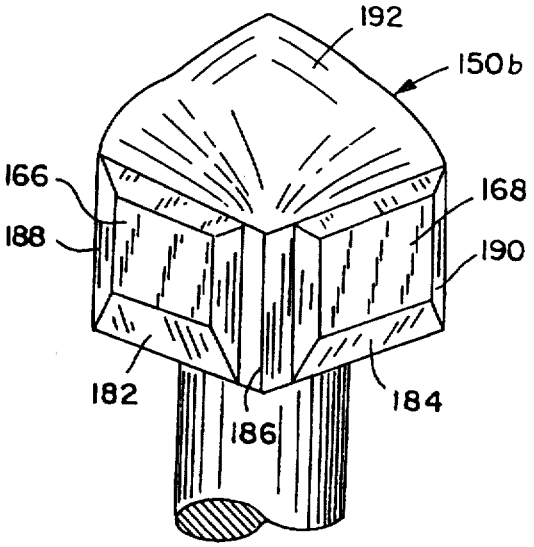
FIG. 9 is an enlarged, perspective, fragmentary view of a lifter head having two protrusions.

The details of a double protrusion lifter head 150b are shown in FIGS. 9, 12 and 13. This lifter head is also generally four sides, with protrusions 166, 168 extending transversely from adjacent sides into the voids of the male mold in which intersecting walls 178 and 180 are formed. The inwardly directed edge of each protrusions is beveled so as to provide inward ramping surfaces 182, 184. The edges of the protrusions 166, 168 opposite the corner 186 at which the walls 178 and 180 intersect, which edges extend generally parallel to the outward direction, are beveled so as to provide release surfaces 188, 190 which slope toward the corner 186. The outer surface 192 is shaped to match the contours of the mold projection into which the lifter head is recessed when retracted.

Figure 10:
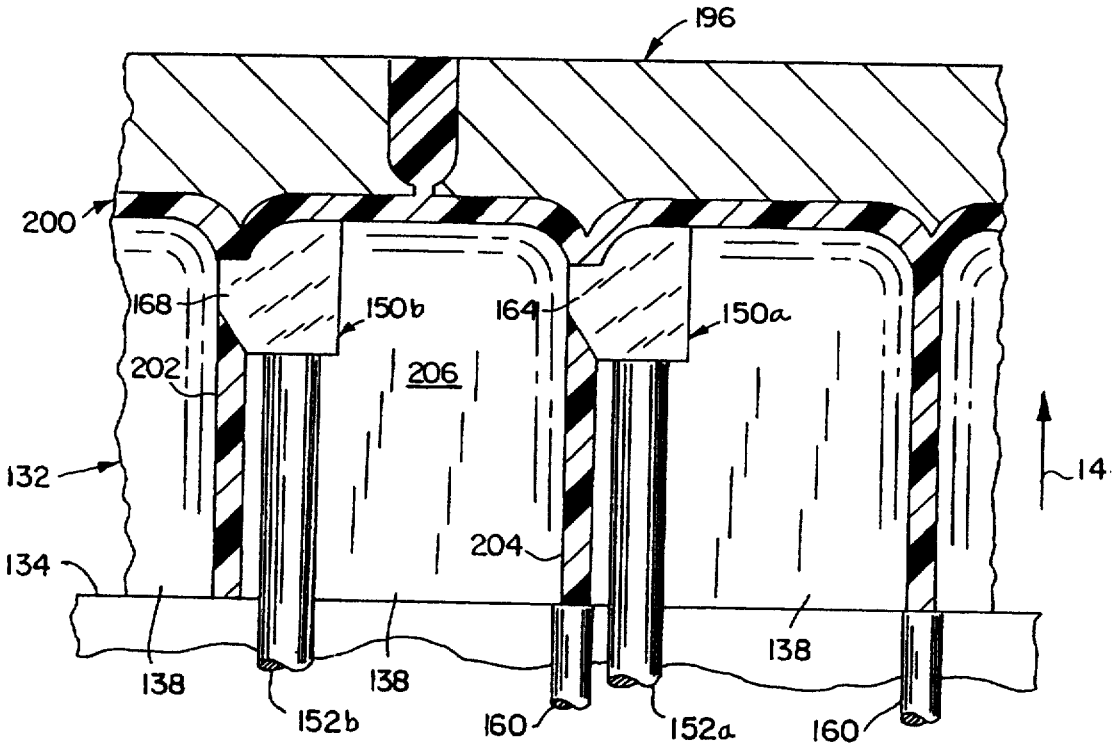
FIG. 10 is a fragmentary, elevational, sectional view of a molding apparatus similar to that shown in FIG. 7 taken along a line adjacent the lifter heads with the lifter heads and ejector pins retracted.
Figure 11:
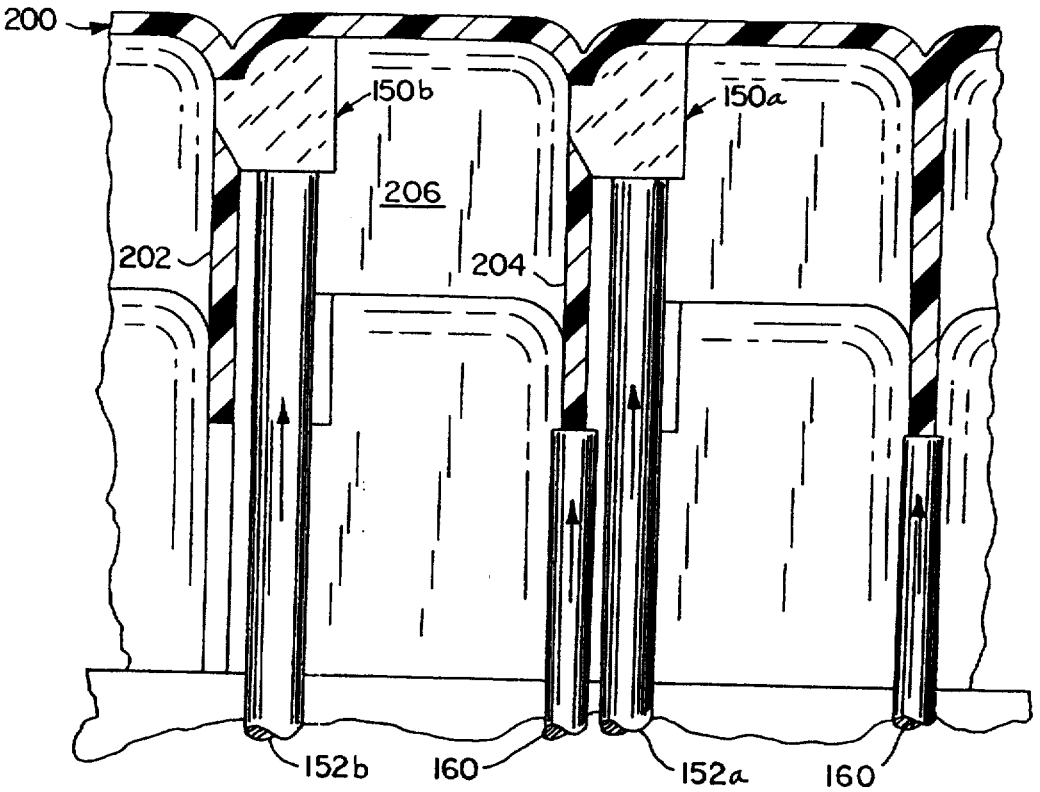
FIG. 11 is similar to FIG. 10 but showing the lifter heads fully extended and the ejector pins partially extended.

The operation of the mold is illustrated in FIGS. 10–12. As shown in FIG. 10, a molding cycle begins with the lifter heads and lifter rods, such as lifter heads 150a and 150b, retracted into the recesses of the projections 138 of the male mold 132. Ejector pins 160 are retracted so that their outer ends are flush with the mold base outer surface 134. Female mold 196 is closed in cooperation with the male mold so as to define the void in which the panel half will be formed.

Molten plastic is then injected into the void to form the panel half 200. The panel half is formed with internal ribs such as walls 202, 204, and 206 formed in the voids between the projections. The direction of panel half removal 144 is determined by the orientation of the walls. Protrusion 164 of lifter head 50a extends transversely to the removal direction 144 into wall 104. Protrusion 168 of lifter head 150b extends transversely into wall 102. The second protrusion (not shown) of lifter head 150b extends transversely into wall 106.

Referring now to FIG. 11, when the plastic has hardened sufficiently, an appropriate driving apparatus moves lifter plate 154 and ejector plate 162 (FIG. 7) outwardly by equal rates and distances. The movement of the plates causes the lifter rods 152a, 152b and ejector pins 160 to extend outwardly from the mold. The lifter heads 150a, 150b and ejector pins 160 push the panel half 200 outwardly off the mold projections. The movement is stopped when the walls 202, 204 and 206 are clear of the mold projections.

When the lifter plate 154 reaches the limit of its outward movement, the panel half walls are clear of the mold projections. Then, the ejector plate continues to move outwardly. As shown in FIG. 12, the ejector pins extend to push the panel half outward off the lifter heads 150a, 150b.

The movement of the panel half 200 off the lifter heads is facilitated by the inward ramping surfaces 172, 184 and 182 (FIG. 7). The inward ramping surfaces of the lifter heads form correspondingly beveled faces 210, 212, 214 in the walls 204, 206, and 202, respectively, of the panel half. The beveled faces form a portion of the perimeter of the wall openings 122.

Still referring to FIG. 12, as the ejector pins 160 move the panel half outwardly off the lifter heads 150a, 150b, the sliding contact between the inward ramping surfaces 172, 184 of the lifter heads causes the panel half to shift transversely as indicated by arrow 216. Additionally, the panel half is preferably removed from the mold at a time when the plastic has cooled to a point at which the outer surface of the plastic has formed a hardened, resilient skin, yet the core of the plastic is still soft. At this point of cooling, the skin of the plastic is able to deflect to allow the panel half to pass the protrusions of the lifting head. The plastic also possesses a shape memory which causes the panel half to return to its intended shape after it has passed the lifting head protrusions. For example, for a polypropylene panel, a suitable core temperature would be approximately 275–300 degrees F., with a skin thickness of 0.015–0.020 inch.

In addition to the transverse movement represented by arrow 216, the panel half may also move in a transverse direction angularly offset to direction 216 to allow the second protrusion 166 (FIG. 9) of lifting head 150b to disengage from wall 206. To illustrate this feature, FIG. 13 shows a fragment of a mold according to the invention having one single protrusion lifter head 150a and several double protrusion lifter heads 150b. The release surfaces 174, 188, and 190 of all the lifter heads are oriented in a common transverse, oblique direction, indicated by arrow 220. As the panel half 200 is pushed outwardly off the lifter heads by the ejector pins, the sliding contact between inward ramping surfaces 172, 182, and 184 (FIGS. 6 and 7) of the lifter heads with the beveled surfaces 210, 212, and 214 (FIG. 10) of the wall openings causes the panel half to shift in direction 220. The release surfaces 174, 188, and 190 allow this shift to occur.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive privilege or right is claimed are defined as follows:

1. A modular building panel comprising:

first and second one-piece panel halves each molded of a polymeric material; each panel half including a front wall, two side walls, a top wall, a bottom wall, and internal ribs; said front wall being a substantially flat rectangular surface having a top edge, a bottom edge and two side edges; said side walls, said top wall, and said bottom wall extending perpendicularly backward from said side edges of said front wall, said top edge of said front wall, and said bottom edge of said front wall, respectively, wherein said side walls, said top wall and said bottom wall each including a backward edge, said backward edges defining a plane parallel to said front wall; said internal ribs are comprised of several intersecting lateral and longitudinal walls extending perpendicularly backward from said front wall, said internal ribs each including a backward edge that lies in said plane defined by said backward edge of said side walls, said top wall and said bottom wall; said lateral walls extending laterally between said side walls, and said longitudinal walls extending longitudinally between said top wall and said bottom wall; said internal ribs and said side walls integrally defining passageways which are comprised of a plurality of openings defined within said internal ribs and said side walls, such that wiring, insulation or the like can be installed within the panels; said passageways disposed such that they do not intersect said backward edge of said side walls or said internal ribs; said first and second panel halves being joined to one another in back-to-back disposition; and means for joining said first and second panel halves to one another along said backward edges of said side walls, said top walls, said bottom walls, and said internal ribs.

2. A modular building panel as defined in claim 1 wherein said passageways defined in said side walls and said longitudinal walls are in substantial lateral alignment, and said passageways in said lateral walls are in substantial longitudinal alignment.

3. A modular building construct comprising:

two modular building panels;

a connector means for connecting said two modular building panels;

each of said modular building panels including an assembly of two one-piece panel halves molded of a polymeric material, said panel halves comprised of a front wall, two side walls, a top wall, a bottom wall, and internal ribs, said front wall being a substantially flat rectangular surface having a top edge, a bottom edge and two side edges, said side walls, said top wall, and said bottom wall each including a backward edge and extending perpendicularly backward from said side edges of said front wall, said top edge of said front wall, and said bottom edge of said front wall, respectively, said internal ribs comprised of several intersecting lateral and longitudinal walls extending perpendicularly backward from said front wall, said internal ribs each including a backward edge that lies in a plane defined by said backward edge of said side walls, said top wall and said bottom wall; said lateral walls extending laterally between said side walls, and said longitudinal walls extending longitudinally between said top wall and said bottom wall, said internal ribs and said wide walls integrally defining passageways comprised of a plurality of openings defined within said internal ribs and said side walls, such that wiring, insulation or the like can be installed within the panels, said passageways disposed such that they do not intersect said backward edge of said side walls or said internal ribs; said panel halves being in back-to-back disposition, and joined together along said backward edges of said side walls, said top walls, said bottom walls, and said internal ribs.

4. A modular building construct as defined in claim 4 wherein said front wall further includes a recessed flange extending around its periphery, wherein said panels each include substantially hat shaped panel ends each having external dimensions; said connector means comprising an "H" shaped member having two open ends each having internal dimensions, wherein said internal dimensions of said two open ends are substantially equal to said external dimensions of said hat shaped panel ends; said two modular building panels being connected by disposing said "H" shaped connector between said panel ends of said two modular building panels, wherein a first of said open ends securely receives one of said panel ends of a first of said two modular building panels and the second of said open ends securely receives one of said panels ends from the second of said two modular building panels.

5. A modular building construct as defined in claim 3 wherein said side walls further include an "L" shaped flange extending longitudinally therefrom, such that cooperation of said "L" shaped flanges of joined panel halves renders a "T" shaped flange having two lips extending from said panel ends; said connector means comprising two "C" shaped members; said two modular building panels being connected by mating said two modular building panels such that said lips of said "T" shaped panel ends are coextensively disposed, and said two "C" shaped connectors being securely inserted over said lips from opposite directions.

6. A modular building construct as defined in claim 3 wherein said passageways defined in said side walls and said longitudinal walls are in substantial lateral alignment, and said passageways in said lateral walls are in substantial longitudinal alignment.

7. A modular building panel comprising:

first and second one-piece polymeric panel halves each including a front wall, a circumferential outer wall extending substantially perpendicularly from the periphery of said front wall, a plurality of internal ribs extending from said front wall in a direction substantially identical to said outer wall, a plurality of integrally formed passageways defined within said outer wall and said internal ribs wherein said passageways do not intersect with said mating surfaces of said panel halves, said panel halves abutting and adjoined to one another with their respective outer walls and ribs aligned; and means for joining said panel halves along all mating edges of said outer walls and said internal ribs.

8. A modular building panel as defined in claim 7 wherein said internal ribs are comprised of several longitudinally extending walls and several laterally extending walls.

9. A modular building panel as defined in claim 8 wherein said panel halves are joined by a welding process.

10. A modular building panel as defined in claim 9 wherein said passageways defined in said outer wall and said longitudinally extending walls are in substantial lateral alignment, and said passageways in said laterally extending walls are in substantial longitudinal alignment.

11. A modular building panel comprising:

first and second one-piece panel halves each fabricated as a single unitary piece, each of said panel halves including a front face and a plurality of ribs extending in a common direction therefrom, each of said ribs terminating opposite said front face in an edge, said ribs cooperating with said front face to define chambers, at least some of said ribs defining apertures therethrough, said apertures not intersecting said rib edges, at least some of said apertures in different ribs being linearly aligned, said panel halves abutting and adjoined to one another so that said rib edges in said panel halves align with and abut one another; and intersecuring means for intersecuring said abutting panel halves along substantially all of said abutting rib edges.

* * * * *